US006453923B2

(12) United States Patent
Zheng

(10) Patent No.: US 6,453,923 B2
(45) **Date of Patent: *Sep. 24, 2002**

(54) COLLAPSIBLE STRUCTURES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/730,027

(22) Filed: Dec. 5, 2000

Related U.S. Application Data

(63) Continuation-in-part of application No. 09/633,947, filed on Aug. 8, 2000, which is a division of application No. 09/162,086, filed on Sep. 29, 1998, now abandoned, which is a division of application No. 08/859,876, filed on May 21, 1997, now Pat. No. 5,816,279, which is a division of application No. 08/627,875, filed on Apr. 3, 1996, now Pat. No. 5,664,596, which is a continuation of application No. 08/281,369, filed on Jul. 27, 1994, now Pat. No. 5,560,385, which is a continuation-in-part of application No. 08/024,690, filed on Mar. 1, 1993, now Pat. No. 5,467,794, which is a continuation-in-part of application No. 07/764,784, filed on Sep. 24, 1991, now Pat. No. 5,301,705.

(51) Int. Cl.[7] ..... F04H 15/40

(52) U.S. Cl. ..... 135/126; 135/130; 135/143; 135/117; 446/478

(58) Field of Search ..... 135/125, 126, 135/28, 130, 137, 143, 117; 446/476, 478, 487; D21/834

(56) References Cited

U.S. PATENT DOCUMENTS

| | | | | | |
|---|---|---|---|---|---|
| 4,632,138 | A | * | 12/1986 | Irwin | 135/143 |
| 4,825,892 | A | * | 5/1989 | Norman | 135/126 |
| 5,038,812 | A | | 8/1991 | Norman | |
| 5,411,046 | A | * | 5/1995 | Wan | 135/126 |
| 5,592,961 | A | * | 1/1997 | Chin | 125/125 |
| 5,778,915 | A | * | 7/1998 | Zheng | 135/126 |
| 5,816,954 | A | | 10/1998 | Zheng | |
| 6,073,643 | A | | 6/2000 | Zheng | |
| D429,307 | S | * | 8/2000 | Wu et al. | D21/834 |
| 6,098,349 | A | | 8/2000 | Zheng | |

FOREIGN PATENT DOCUMENTS

| | | |
|---|---|---|
| FR | 2635136 | 2/1990 |

* cited by examiner

*Primary Examiner*—Lanna Mai
*Assistant Examiner*—Winnie Yip
(74) *Attorney, Agent, or Firm*—Raymond Sun

(57) ABSTRACT

A collapsible structure has at least three foldable frame members, each having a folded and an unfolded orientation. The structure has a fabric material covering portions of each frame member to form a panel for each frame member, with each panel further including a left side, a bottom side and a right side, with the left side of each panel coupled to the right side of an adjacent panel, and the right side of each panel coupled to the left side of another adjacent pane. The bottom side of at least one panel is positioned at a higher vertical level than the bottom side of at least one other panel.

14 Claims, 17 Drawing Sheets

COLLAPSIBLE STRUCTURES

This is a continuation-in-part of co-pending Ser. No. 09/633,947, entitled "Collapsible Play Structures", filed Aug. 8, 2000, which is a division of Ser. No. 09/162,086, entitled "Collapsible Play Structures", filed Sep. 29, 1998, now abandoned, which is a division of Ser. No. 08/859,876, entitled "Collapsible Play Structures", filed May 21, 1997, now U.S. Pat. No. 5,816,279, which is a division of Ser. No. 08/627,875, entitled "Collapsible Play Structures", filed Apr. 3, 1996, now U.S. Pat. No. 5,664,596, which is a continuation of Ser. No. 08/281,369, entitled "Collapsible Play Structures", filed Jul. 27, 1994, now U.S. Pat. No. 5,560,385, which is a continuation-in-part of Ser. No. 08/024,690, entitled "Collapsible Shade Structure", filed Mar. 1, 1993, now U.S. Pat. No. 5,467,794, which is in turn a continuation-in-part of Ser. No. 07/764,784, entitled "Collapsible Shade Structure", filed Sep. 24, 1991, now U.S. Pat. No. 5,301,705, the entire disclosures of which are incorporated by this reference as though set forth fully herein.

BACKGROUND OF THE INVENTION

1. Related Cases

2. Field of the Invention

The present invention relates to collapsible structures, and in particular, to collapsible structures that are made up of a plurality of panels that have different shapes and sizes, so as to enhance the utility and variety of use for these collapsible structures.

3. Description of the Prior Art

There are presently many collapsible structures that are being provided for use by children and adults. Examples of these collapsible structures are illustrated in the following patents: U.S. Pat. No. 5,816,954 (Zheng), U.S. Pat. No. U.S. Pat. No. 6,006,772 (Zheng), U.S. Pat. No. 5,778,915 (Zheng), U.S. Pat. No. 5,467,794 (Zheng), U.S. Pat. No. 5,975,101 (Zheng), U.S. Pat. No. 5,722,446 (Zheng), U.S. Pat. No. 4,858,634 (McLeese), U.S. Pat. No. 4,825,592 (Norman), U.S. Pat. No. 5,964,533 (Ziglar), U.S. Pat. No. 5,971,188 (Kellogg et al.), and U.S. Pat. No. 5,038,812 (Norman), among others. These collapsible structures are supported by one or more frame members that can be twisted and folded to reduce the overall size of the structure. These collapsible structures can be used in a wide variety of applications, such as containers, tents, play structures, executive toys, shelters, sports structures, and others. As a result, collapsible structures have become very popular.

Even though these collapsible structures exhibit surprising versatility in their utility and wide-ranging applications, the consumer is always demanding greater enhancements, better and more features, added convenience, and other related factors. For example, in most of the structures described in the patents set forth above, the panels that make up the final structure are usually of the same size and shape. This may place limitations on the shapes and sizes of the resulting structures.

Thus, there remains a need to provide collapsible structures that have increased variety of play, entertainment value, and utility.

SUMMARY OF THE DISCLOSURE

The present invention provides a collapsible structure having at least three foldable frame members, each having a folded and an unfolded orientation. The structure has a fabric material covering portions of each frame member to form a panel for each frame member, with each panel further including a left side, a bottom side and a right side, with the left side of each panel coupled to the right side of an adjacent panel, and the right side of each panel coupled to the left side of another adjacent pane. The bottom side of at least one panel is positioned at a higher vertical level than the bottom side of at least one other panel.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention. is best defined by the appended claims.

The present invention provides collapsible structures that are made up of panels that have different shapes and sizes. By varying the shapes and sizes of these panels, the present invention allows the resulting collapsible structures to offer improved variety of play, entertainment value, and utility.

Figure 6:
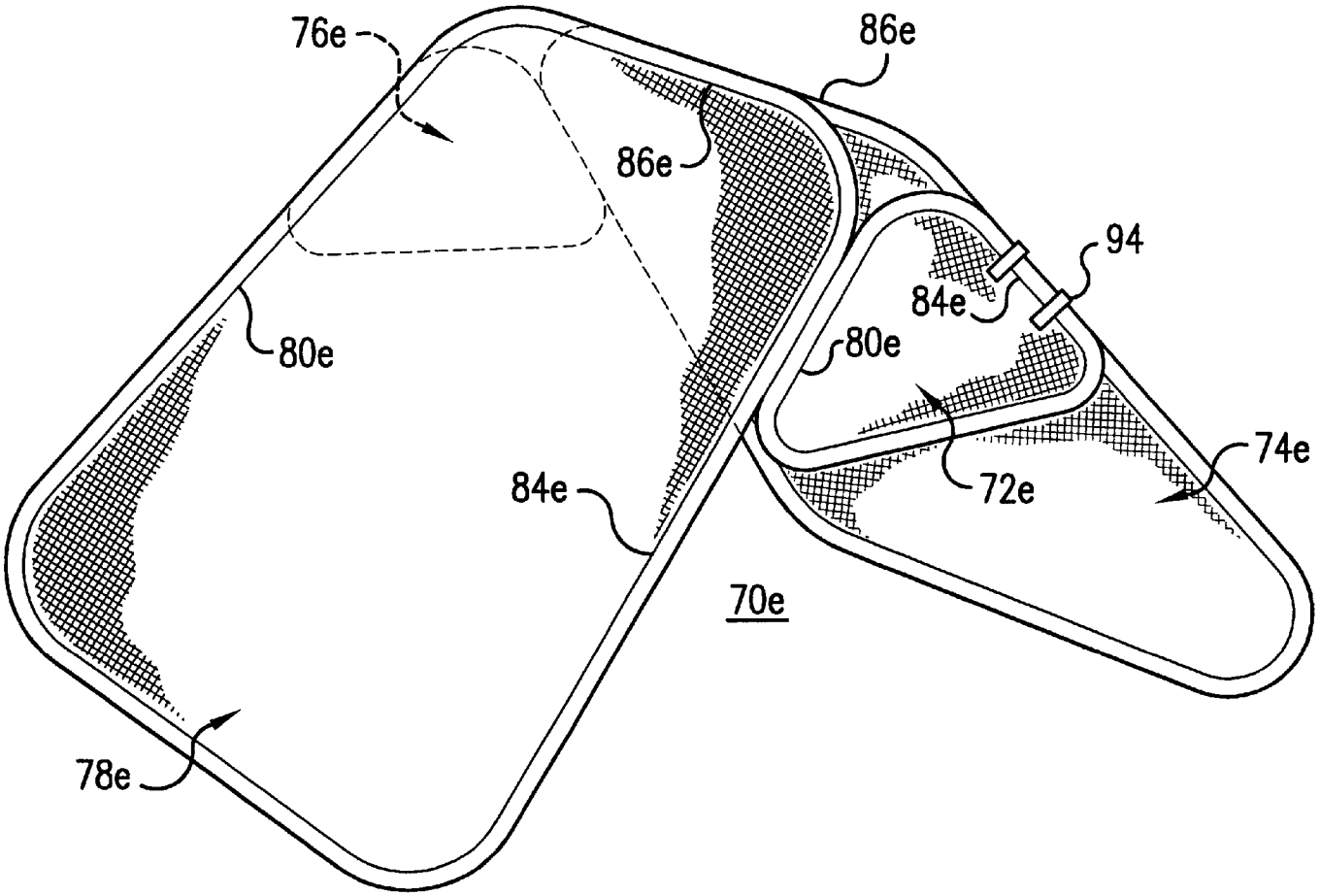
FIG. 6 illustrates modifications to the structure of FIG. 5.

As used herein, the terms "hingedly coupled" or "hingedly connected" mean to couple two edges by stitching or by the use of removable attachment mechanisms, such as straps, hooks, clips, binds, ties, cords, Velcro™ pads (as illustrated in FIG. 6), or opposing toggles and loops.

Figure 1:
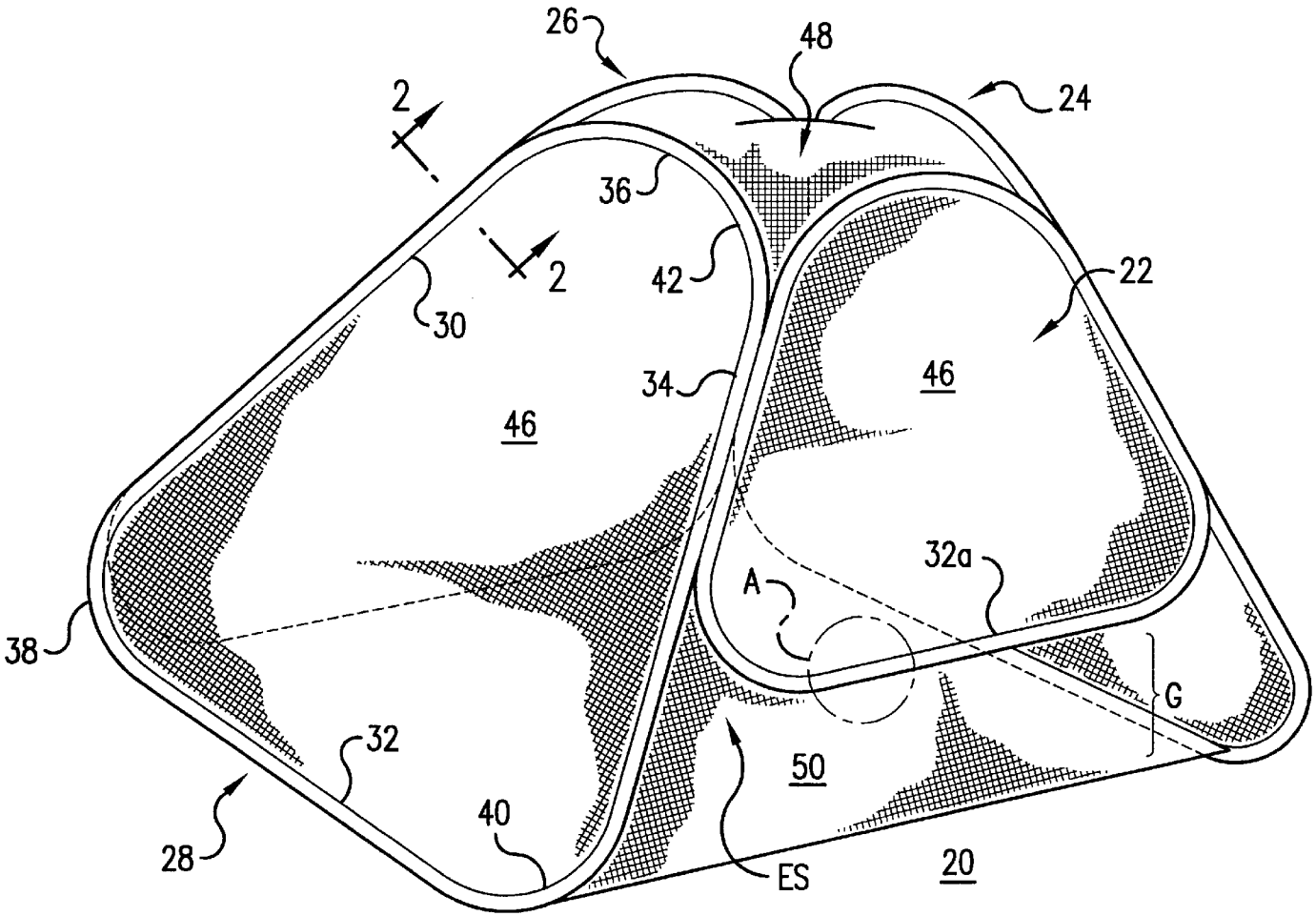
FIG. 1 is a perspective view of a collapsible structure according to one embodiment of the present invention.

FIG. 1 illustrates a collapsible structure 20 that is made up of a plurality of panels that are hingedly coupled together. The structure 20 has four side panels 22, 24, 26 and 28 hingedly connected to each other to encircle an enclosed space ES. Each panel 22, 24, 26, 28 has three sides, a left side 30, a bottom side 32, and a right side 34. A top curved corner 36 couples the left and right sides 30, 34, another curved corner 38 couples the left and bottom sides 30, 32, and yet another curved corner 40 couples the bottom and right sides 32, 34 of each panel 22, 24, 26, 28. The left side 30 of each panel 22, 24, 26, 28 is hingedly coupled to the right side 32 of an adjacent panel 22, 24, 26, 28 to encircle the enclosed space ES.

Even though each panel 22, 24, 26, 28 is illustrated as having four sides, it is possible to configure any of these panels 22, 24, 26, 28 with any shape having different number of sides, including sides that have varying degrees of curvature. For purposes of the present invention, a "side" can have varying degrees of curvature and is not restricted to merely a straight configuration. As a result, each side 30, 32, 34 can be partially or completely curved (e.g., see the embodiment in FIG. 4B).

Figure 1A:
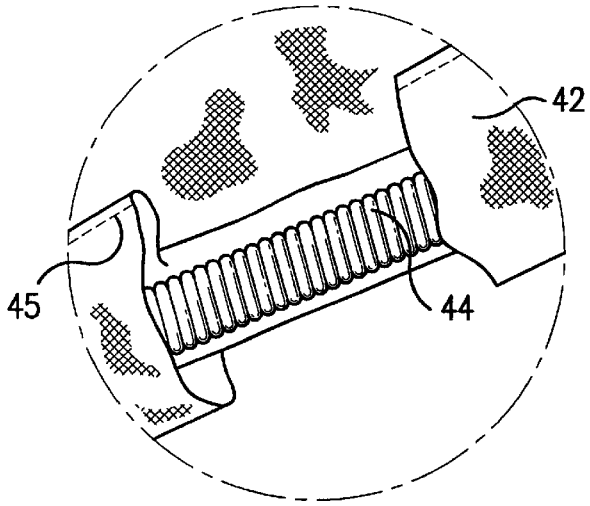
FIG. 1A is a partial cut-away view of the section A of the structure of FIG. 1 illustrating a frame member retained within a sleeve.

Each panel 22, 24, 26, 28 has a continuous frame retaining sleeve 42 provided along and traversing the edges of its sides 30, 32, 34. A continuous frame member 44 is retained or held within each frame retaining sleeve 42 to support each panel 22, 24, 26 and 28. Only the frame member 44 for panel 22 is shown in FIG. 1A; the other frame members 44 for the other panels 24, 26, 28 are not shown but are the same as frame member 44 in FIG. 1A. The continuous frame members 44 may be provided as one continuous loop, or may comprise a strip of material connected at both ends to form a continuous loop. The continuous frame members 44 are preferably formed of flexible coilable steel, although other materials such as plastics may also be used. The frame members 44 should be made of a material which is relatively strong and yet is flexible to a sufficient degree to allow it to be coiled. The material should have a memory that allows the frame members to spring back to the expanded position when unfolded from the folded position. Thus, each frame member 44 is capable of assuming two positions or orientations, an open or expanded position such as shown in FIG. 1, or a folded position in which the frame member is collapsed into a size which is much smaller than its open position.

Fabric or sheet material 46 extends across each panel 22, 24, 26 and 28, and is held taut by the respective frame members 44 when in its open position. The term fabric is to be given its broadest meaning and should be made from strong, lightweight materials and may include woven fabrics, sheet fabrics or even films.

The fabric should be water-resistant and durable to withstand the wear and tear associated with rough treatment by children or outdoor use. The 44 may be merely retained within the respective frame retaining sleeves 42 without being connected thereto. Alternatively, the frame retaining sleeves 42 may be mechanically fastened, stitched, fused, or glued to the frame members 44 respectively, to retain them in position.

Figure 2A:
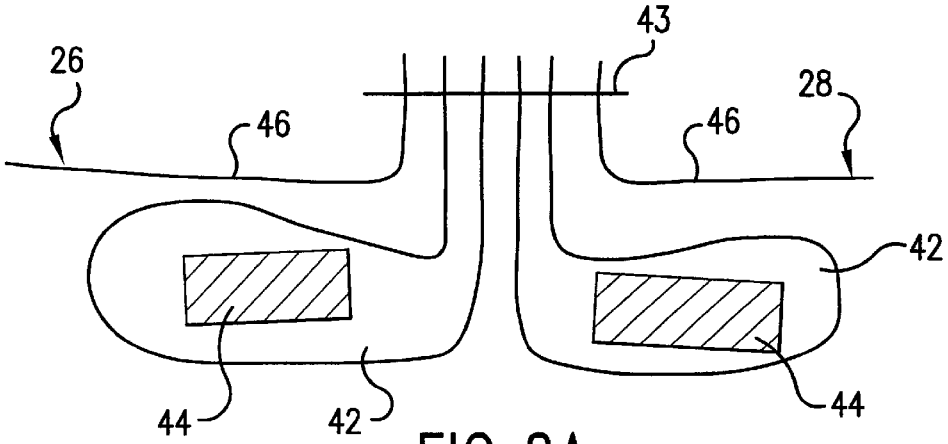
FIG. 2A is a cross-sectional view of a first preferred connection between two adjacent panels of the structure of FIG. 1 taken along line 2—2 thereof.

FIG. 2A illustrates one possible connection for connecting adjacent edges 30 and 34 of two panels 28 and 26, respectively, of FIG. 1. The fabric pieces 46 for the two panels 26, 28 are stitched at their edges by a stitching 43 to the respective sleeves 42. Each sleeve 42 may be formed by folding a piece of fabric. The stitching 43 also acts as a hinge for the panels 26 and 28 to be folded upon each other, as explained below. The connections for the three other pairs of adjacent edges may be identical. Thus, the connections on the left side 30 and the right side 34 of each panel 22, 24, 26 and 28 act as hinge connections for connecting an adjacent panel.

At the top corner 36 and the bottom side 32 of each panel 22, 24, 26 and 28 in FIG. 1, where there is no hinge connection to an adjacent panel, the frame retaining sleeve 42 may be formed by merely folding over the corresponding fabric piece and applying a stitching 45 (see FIG. 1A). The fabric 46 for the corresponding panel may then be stitched to the sleeve 42.

Figure 2B:
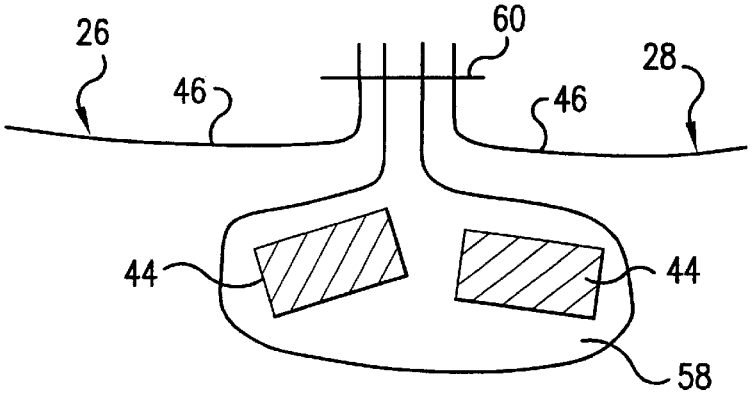
FIG. 2B is a cross-sectional view of a second preferred connection between two adjacent panels of the structure of FIG. 1 taken along line 2—2 thereof.

FIG. 2B illustrates a second possible connection for connecting adjacent edges 30 and 34 of two panels 28 and 26, respectively, of FIG. 1. As in the connection of FIG. 2A, the fabric pieces 46 can be folded over at their edges at the bottom side 32 and the top corner 36 to define the respective sleeves 42. However, the frame retaining sleeves 42 converge at, or are connected to, one sleeve portion which interconnects panels 26 and 28 to form a singular frame retaining sleeve 58 which retains the two frame members 44. Sleeve 58 of FIG. 2B may be formed by providing a tubular fabric, or by folding a piece of fabric, and applying a stitching 60 to its edges to connect the sleeve 58 to the fabric pieces 46. Stitching 60 acts as a hinge for the panels 22 and 28. The connections for the three other pairs of adjacent edges may be identical.

In addition, an optional roof 48 can be stitched or removably connected to the top corners 36 and sides 30, 34 of each panel 22, 24, 26, 28. An optional floor 50 can also be stitched or removably connected to the bottom sides 32 of each panel 22, 24, 26, 28. The roof 48 and the floor 50 can be either a piece of fabric, or can be a separate panel that is similar in construction to any of the panels 22, 24, 26, 28. The fabric used for roof 48 and the floor 50 can be the same type of material as fabric 46.

The three panels 24, 26, 28 can be provided with the same shape and size, but the panel 22 is provided with a similar shape, but of a smaller size. As a result, the bottom side 32*a* of the panel 22 is raised when compared with the bottom sides 32 of the other three panels 24, 26, 28, and only a portion of the side 34 of the panel 28 and the side 30 of the panel 24 are hingedly connected to the sides 30 and 34, respectively, of the panel 22. The bottom sides 32 of the other three panels 24, 26, 28 therefore support the ground or surface when the structure 20 is fully expanded and deployed, and the bottom side 32*a* of panel 22 is vertically raised from the ground by a gap or space G. This gap G can be used as an opening to allow ingress and egress, or can be used to allow ventilation of air into the enclosed space ES.

While the structure 20 of FIG. 1 is shown and described as having four panels, each having three sides, it will be appreciated that a structure may be made of any number of panels, each having any number of sides, without departing from the spirit and scope of the present invention. Thus, the structure 20 of the present invention may take a variety of external shapes. However, each panel of the structure 20, regardless of its shape, is supported by at least one continuous frame member.

Figure 3A:
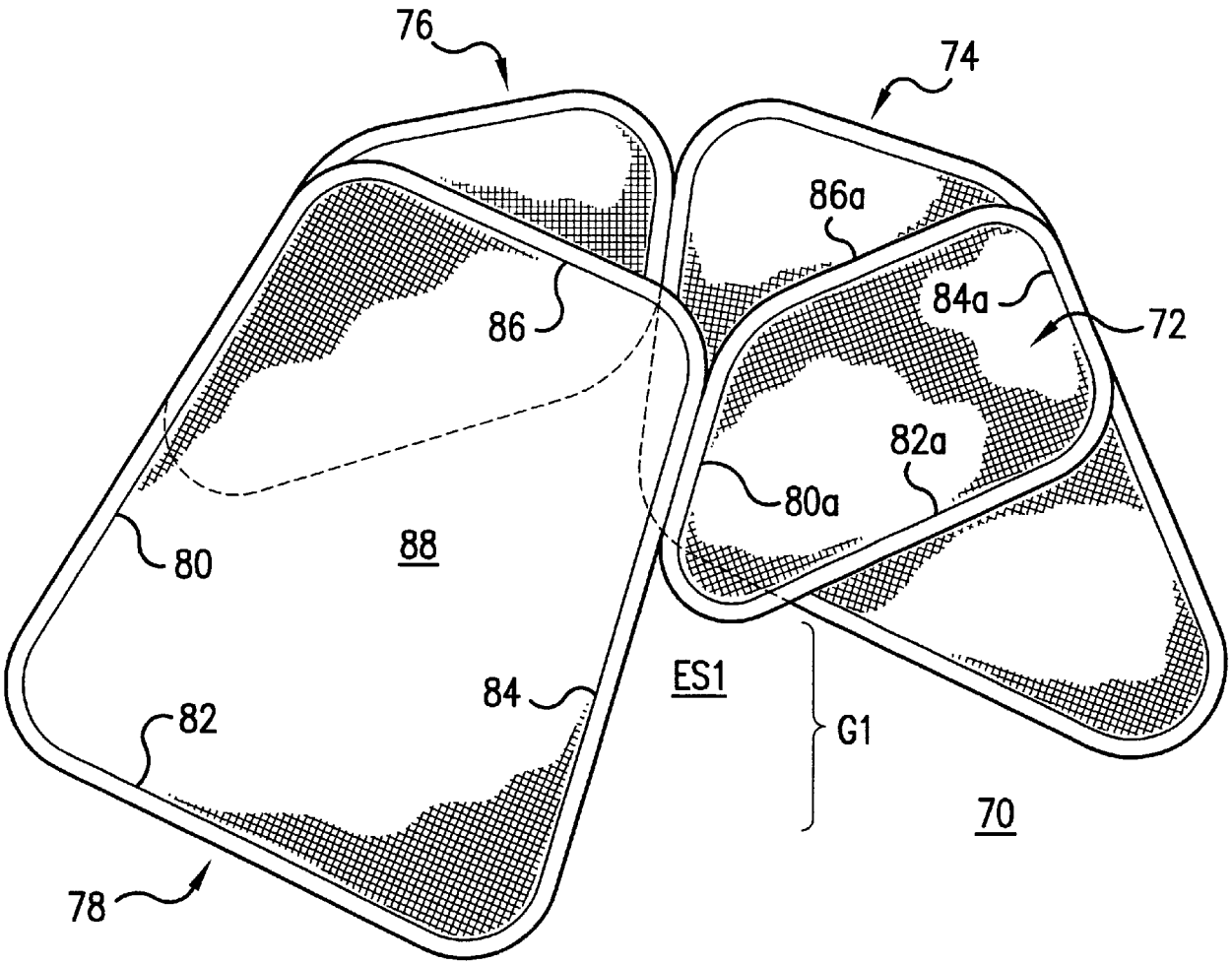
FIG. 3A is a perspective view of a collapsible structure according to another embodiment of the present invention.

FIG. 3A illustrates another collapsible structure 70 according to the present invention. The structure 70 has four side panels 72, 74, 76 and 78 hingedly connected to each other to encircle an enclosed space ES1. Each panel 72, 74, 76, 78 has four sides, a left side 80, a bottom side 82, a right side 84, and a top side 86. The left side 80 of each panel 72, 74, 76, 78 is hingedly coupled to the right side 84 of an adjacent panel 72, 74, 76, 78 to encircle the enclosed space ES1. Each panel 72, 74, 76, 78 is also supported by a continuous frame member such as frame member 44, and has fabric 88 that extends across each panel 72, 74, 76 and 78, and is held taut by the respective frame members when in its open position.

In the structure 70, two of the panels 74 and 78 have the same shape and size, and the other two opposing panels 72 and 76 have the same shape and size, but a slightly different shape and a different size from the panels 74 and 78. Specifically, the opposing panels 72 and 76 are provided with a similar shape as panels 74 and 78, but are of a smaller size. As a result, the bottom side 82*a* of the panels 72 and 76 are raised when compared with the bottom sides 82 of the other two panels 74 and 78, so that only a portion of the sides 80, 84 of the panel 74, 78 are hingedly connected to the sides 80*a*, 84*a* of the panels 72, 76. The bottom sides 82 of the panels 74 and 78 therefore contact the ground or surface when the structure 70 is fully expanded and deployed, and the bottom sides 82*a* of the panels 72 and 76 are vertically raised from the ground by a gap or space G1. This gap G1 can be used as an opening to allow ingress and egress, or can be used to allow ventilation of air into the enclosed space ES1, or can be used for other purposes.

Figure 4A:
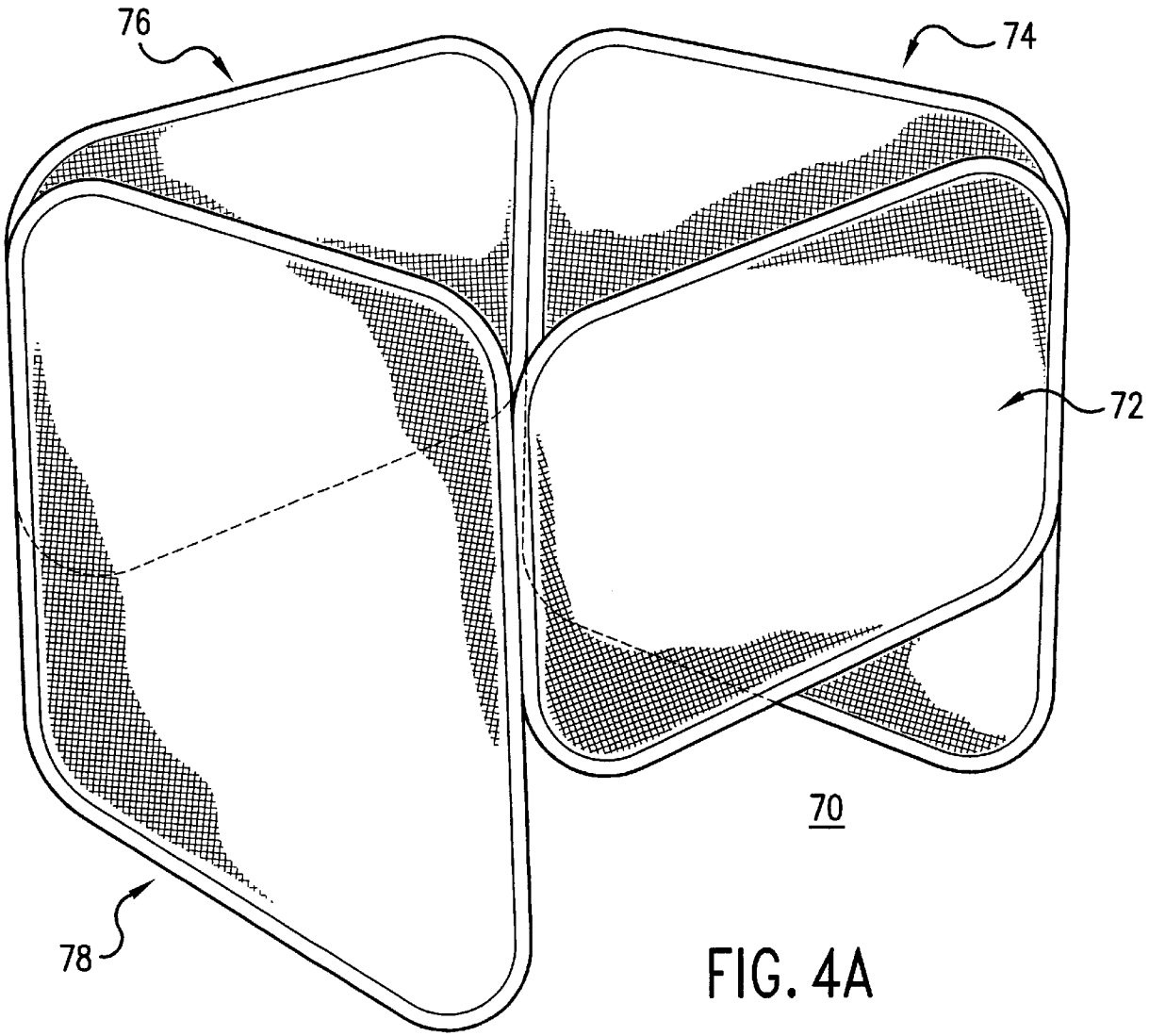
FIGS. 4A, 4B and 5 illustrate modifications to the structure of FIG. 3A.

The left and right sides 80*a* and 84*a* of the panels 72 and 76 can either be angled (i.e., such that the top sides 86*a* are shorter than the bottom sides 82*a*), or vertical. Thus, if the sides 80*a*, 84*a* of the panels 72 and 76 are angled, the other two panels 74 and 78 will be oriented in an angled manner when the structure 70 is deployed as shown in FIG. 3A. On the other hand, if the panels 72 and 76 are vertical, all four panels 72, 74, 76, 78 would be oriented in a vertical manner when the structure 70 is deployed as shown in FIG. 4. The top and bottom of the structure 70 is illustrated in FIGS. 3A and 4 as not having any roof or floor, although a roof and/or a floor can be provided in the manner described above.

Figure 3B:
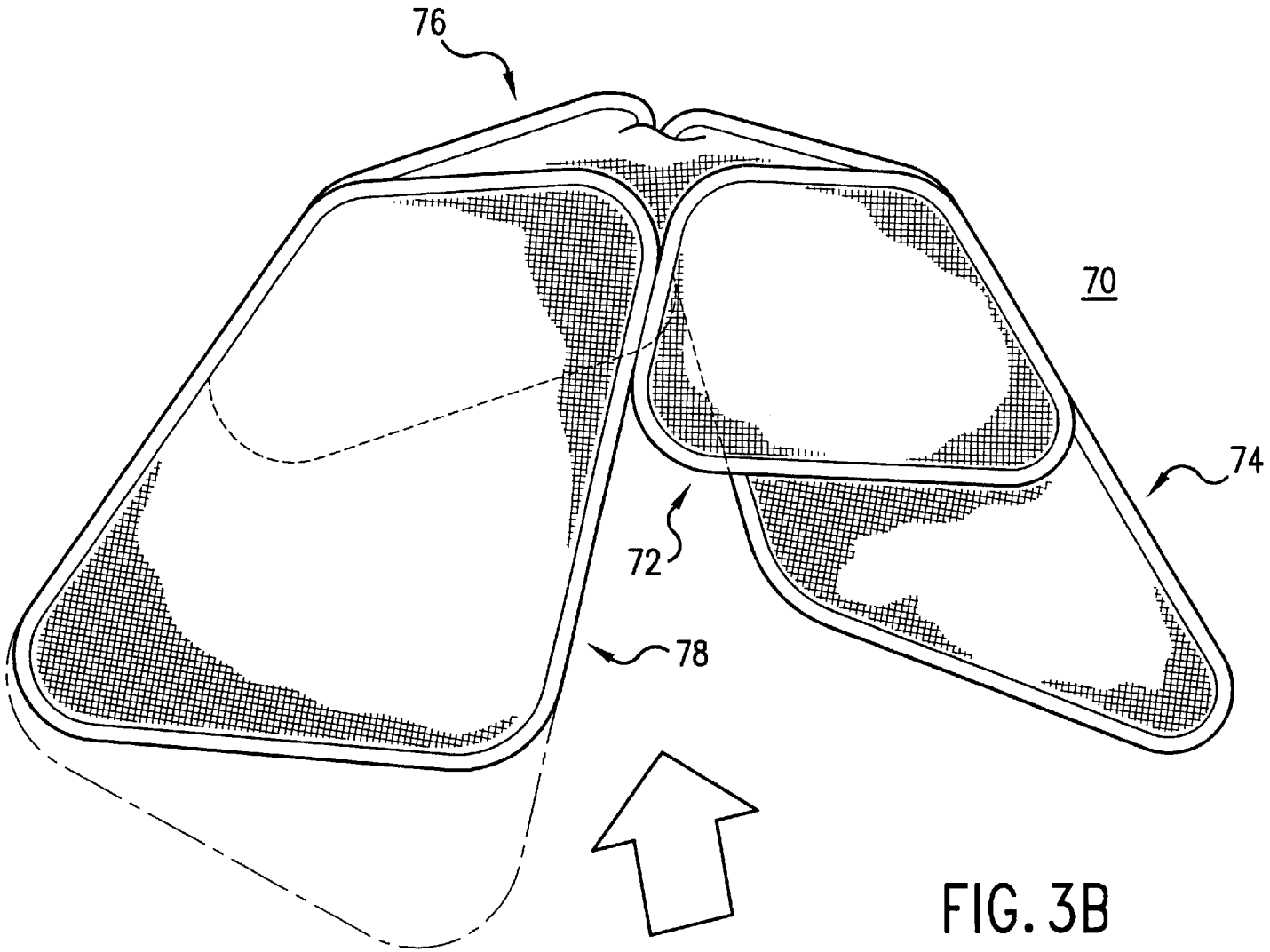
FIGS. 3B through 3G illustrate how the collapsible structure of FIG. 3A may be twisted and folded for compact storage.
Figure 3C:
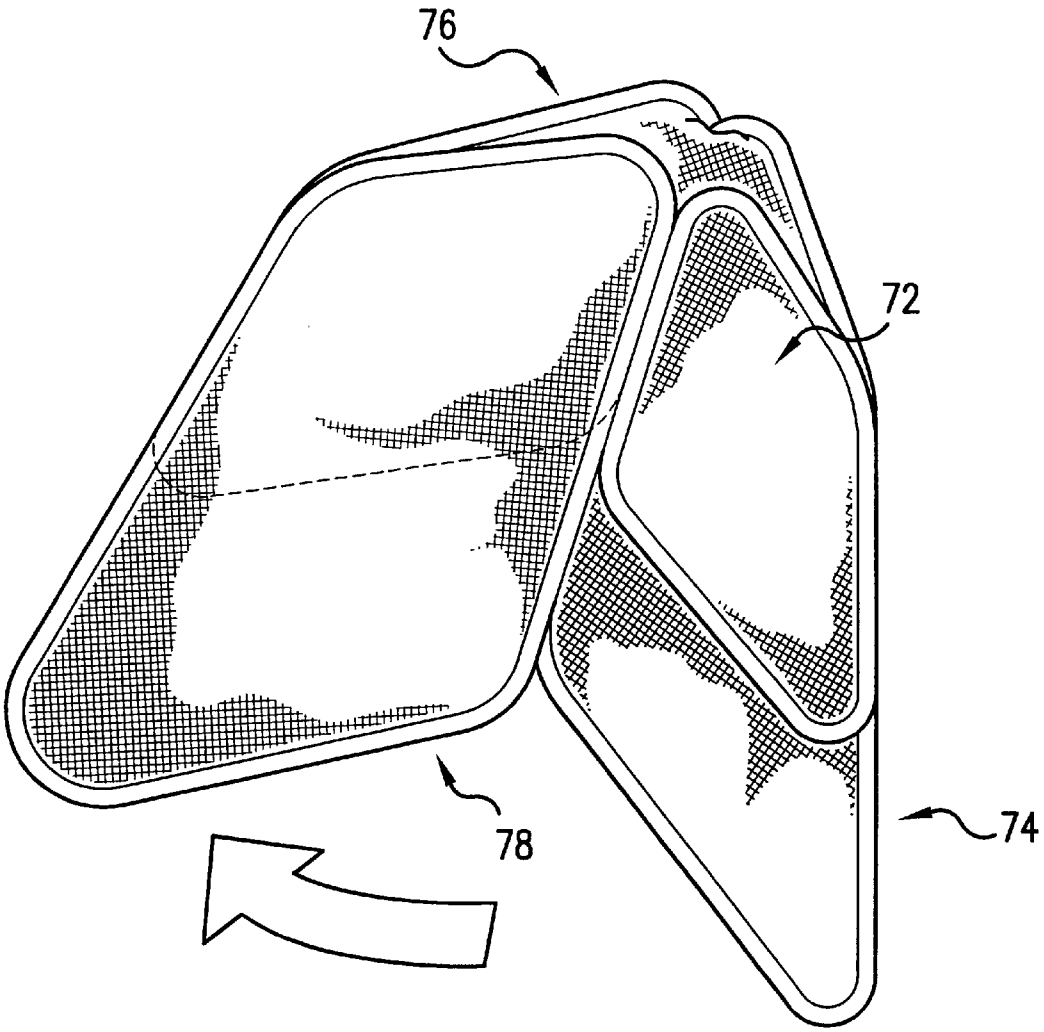
Figure 3D:
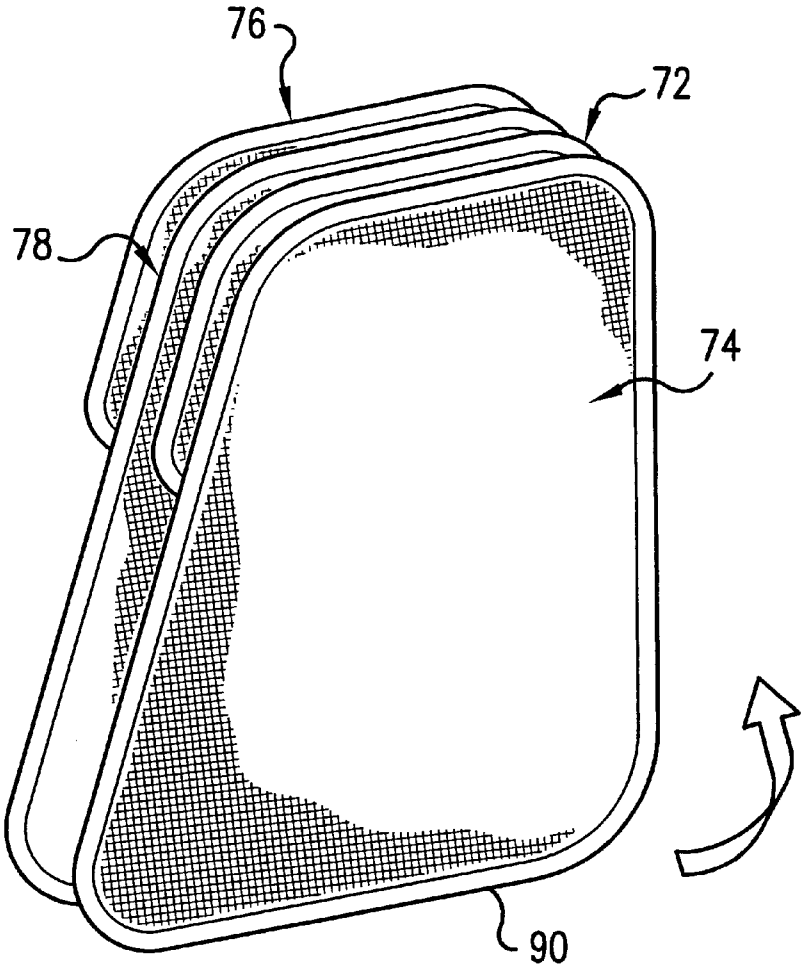
Figure 3E:
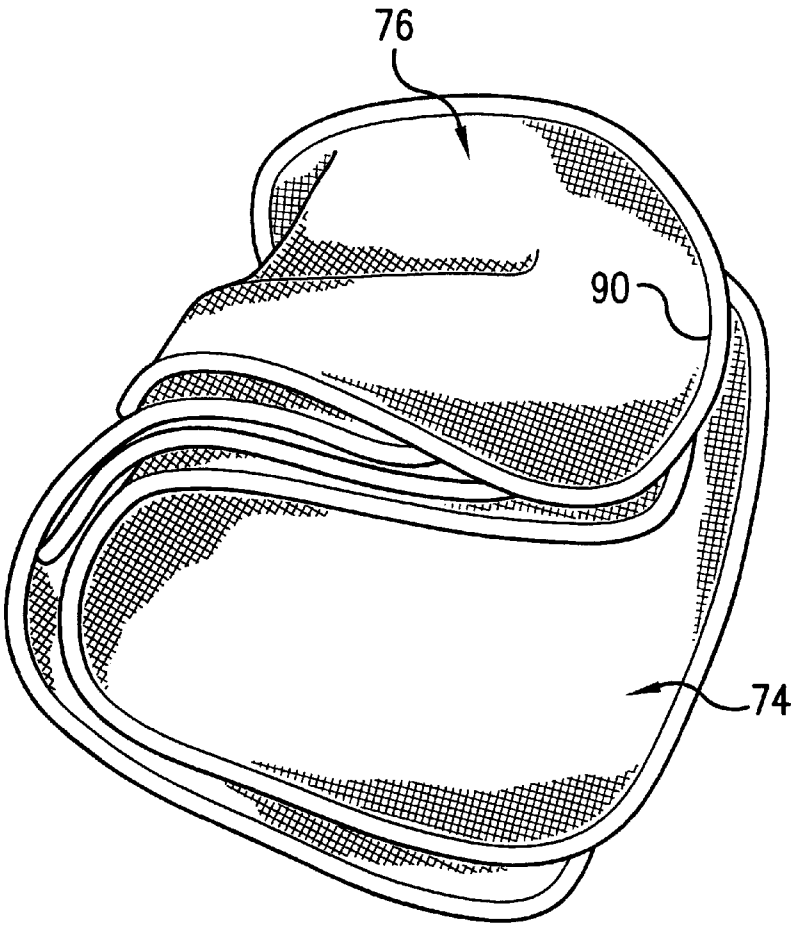
Figure 3F:
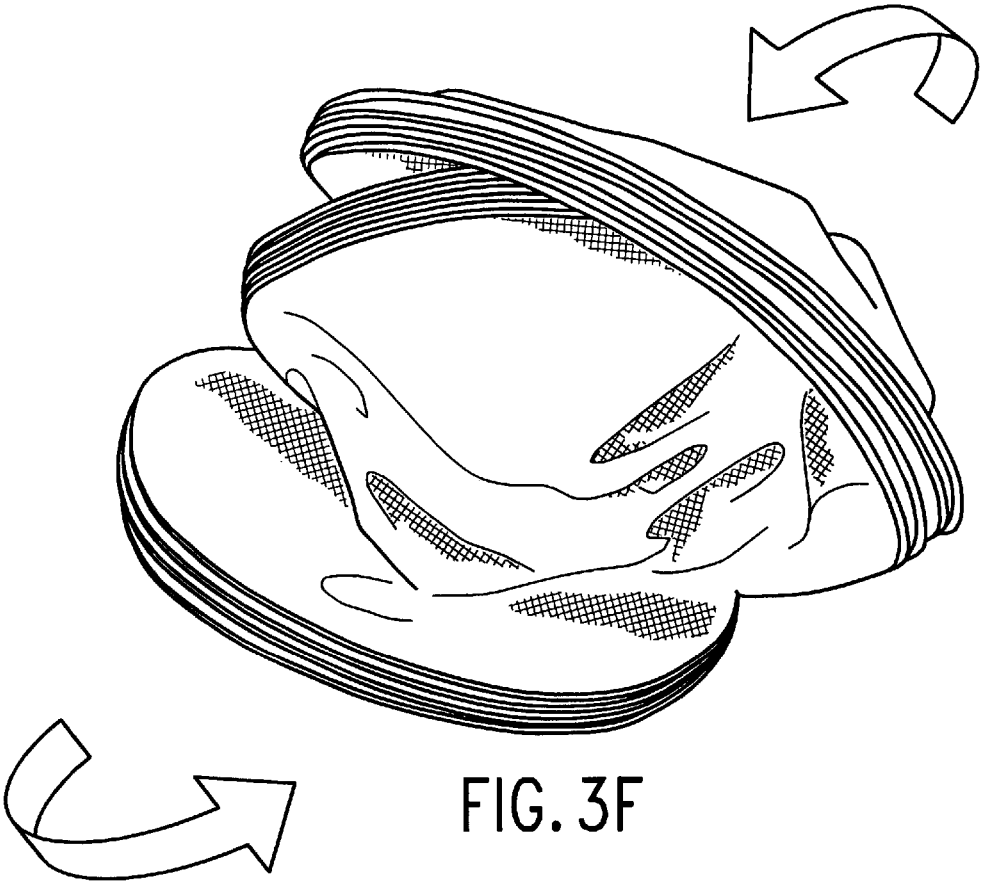
Figure 3G:
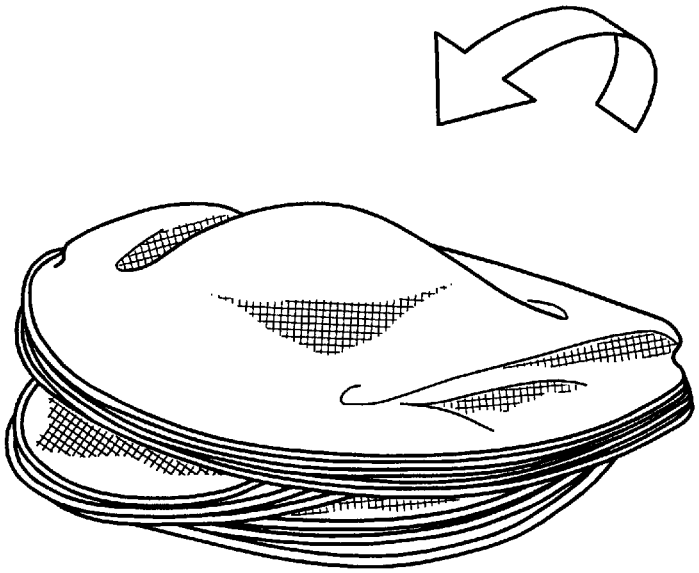

FIGS. 3B through 3F illustrate how the structure 70 of FIG. 3A can be twisted and folded to reduce the structure 70 into a collapsed configuration having a reduced size. The same principles can be applied to collapse all the other embodiments of the present invention. In FIG. 3B, the first step consists of pushing in panels 78 and 72 such that panel 78 collapses upon panel 76, and panel 72 collapses upon panel 74. Then, in the second step shown in FIG. 3C, the two panels 72 and 74 are folded so as to be collapsed upon the two panels 78 and 76. The resulting structure 70 is a stack of four panels 74, 72, 78, 76 (in one order) as shown in FIG. 3D, which is then twisted and folded to collapse the frame members and panels into a smaller shape. In the next step shown in FIG. 3E, the opposite border (designated by the numeral 90) of the structure 70 is folded in upon the previous fold to further collapse the frame members with the panels. As shown in FIG. 3F, the next step is to continue the collapsing so that the initial size of the structure 70 is reduced. FIG. 3G shows the frame members and panels collapsed on each other to provide for a small essentially compact configuration having a plurality of concentric frame members and layers of the panels so that the collapsed structure 70 has a size which is a fraction of the size of the initial structure 70.

To re-open the structure 70 to its expanded configuration, the combined stack of panels is unfolded. The memory (i.e., spring-load) of the frame members 44 will cause the frame members to uncoil on their own and to quickly expand the panels to their expanded configuration shown in FIG. 3D. The same principle can be applied to re-open all the other embodiments of the present invention.

Figure 4B:
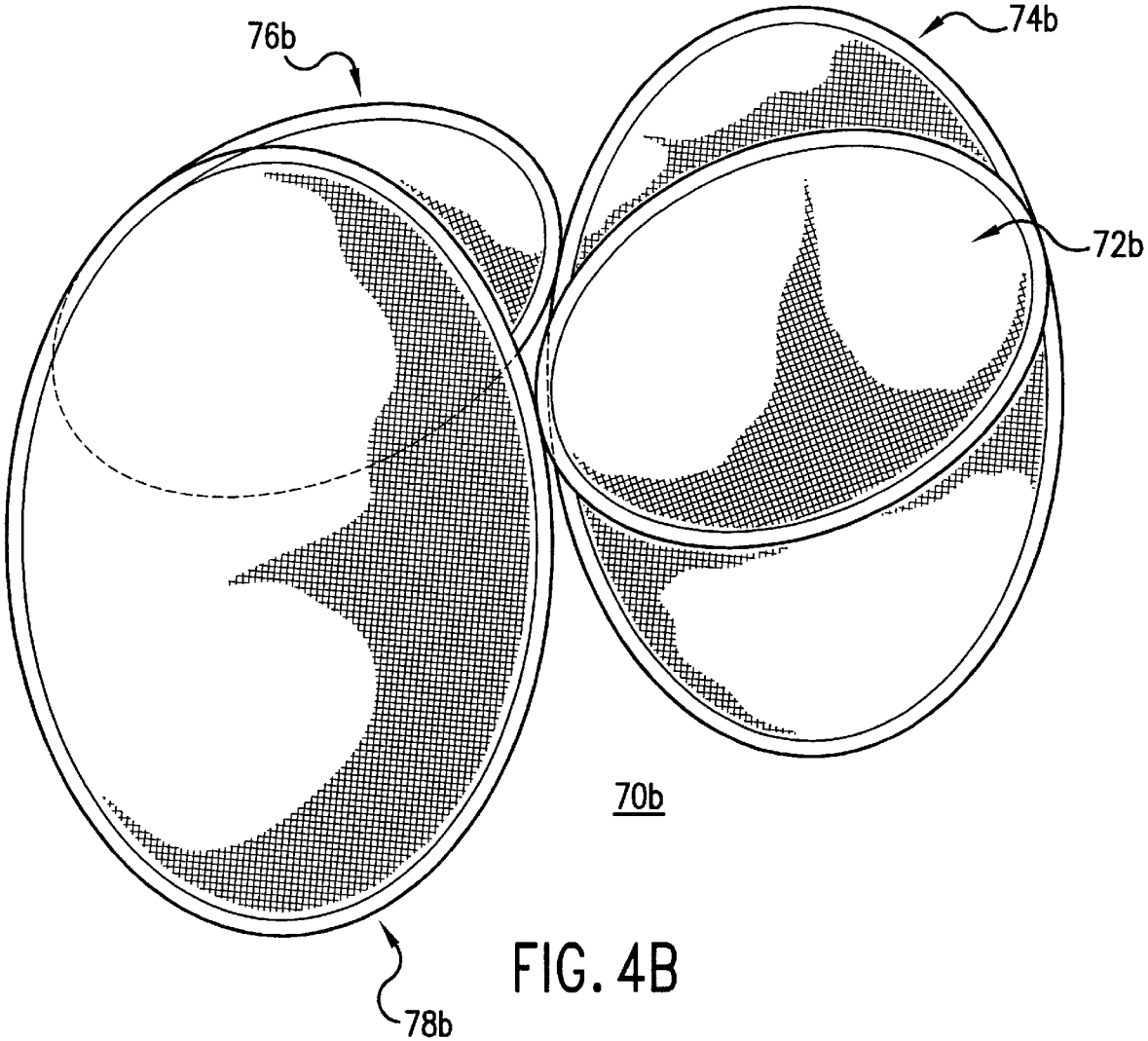

The structure 70*b* in FIG. 4B illustrates a modification to the structure 70 in FIG. 3A. The panels 72*b*, 74*b*, 76*b* and 78*b* are the same as panels 72, 74, 76 and 78 of structure 70, except that all the sides of the panels 72*b*, 74*b*, 76*b* and 78*b* are curved.

Figure 5:
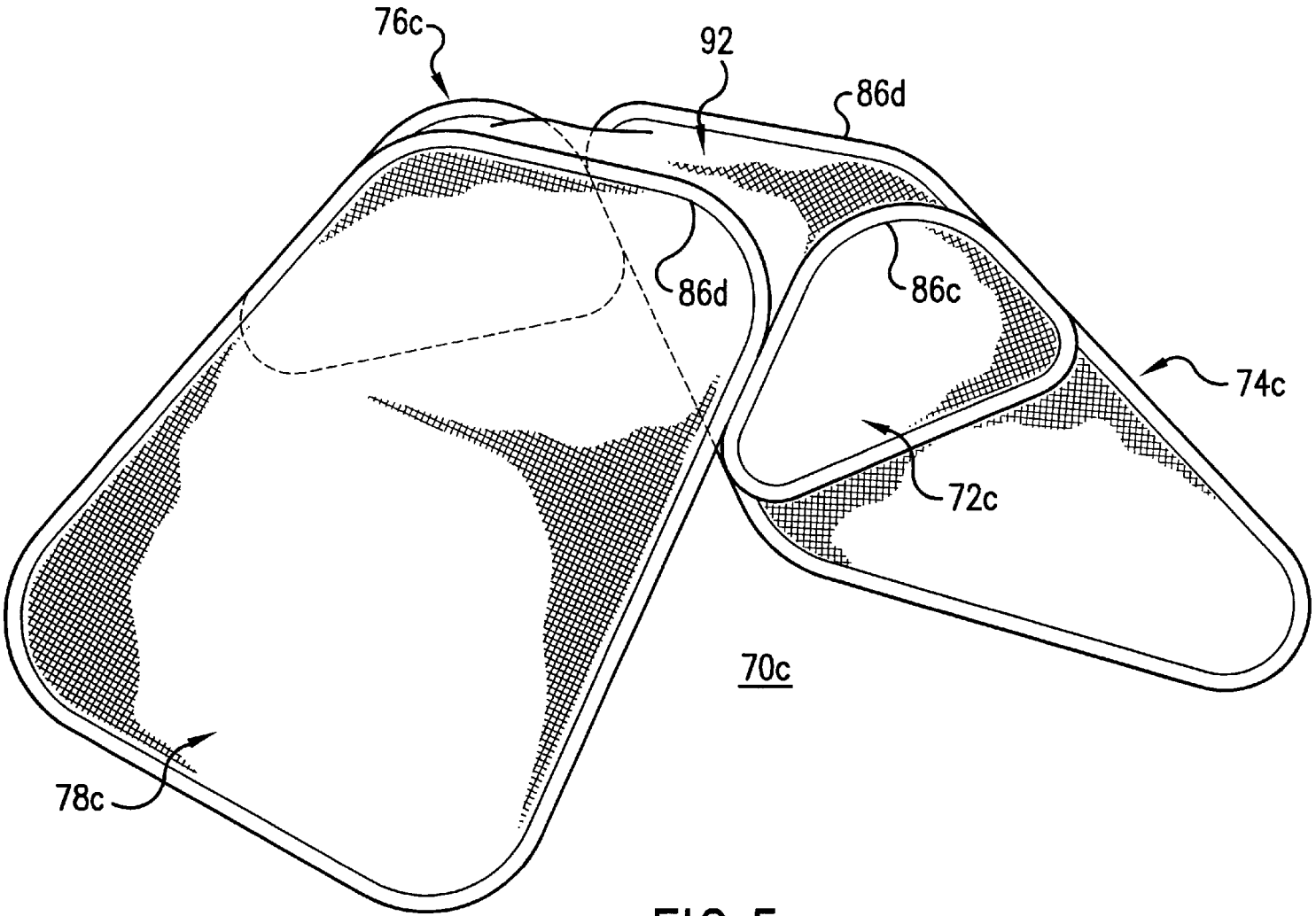

The structure 70*c* in FIG. 5 illustrates another modification to the structure 70 in FIG. 3A. The panels 74*c* and 78*c* are the same as panels 74 and 78 in FIG. 3A, but the panels 72*c* and 76*c* have a much shorter top side 86*c*, or the top side 86*c* can even be a top curved corner. As a result, the top sides 86*d* of the panels 74*c* and 78*c* are much closer to each other than the top sides 86 of the panels 74 and 78. In FIG. 5, an optional roof 92 can be stitched or removably connected to the top sides 86*c* and 86*d* of each panel 72*c*, 74*c*, 76*c*, 76*d*.

The structure 70*e* in FIG. 6 illustrates a further modification of the structure 70*c* in FIG. 5. The panels 74*e* and 78*e* are the same as panels 74*c* and 78*c* in FIG. 5, and the panels 72*e* and 76*e* can be the same as panels 72*c* and 76*c* in FIG. 5, but here, the size of the panels 72*e* and 76*e* has been reduced so that the top sides 86*e* of the panels 74*e* and 78*e* can be hingedly connected to each other. In the structure 70*e* of FIG. 6, the raised panels 72*e* and 76*e* can be used to support the two panels 74*e* and 78*e* at a predetermined distance and angle apart from each other. Also illustrated in FIG. 6 is the use of opposing Velcro™ straps 94 to couple the sides 80*e* and 84*e* of the panels 72*e*, 74*e*, 76*e*, 78*e*.

Figure 7:
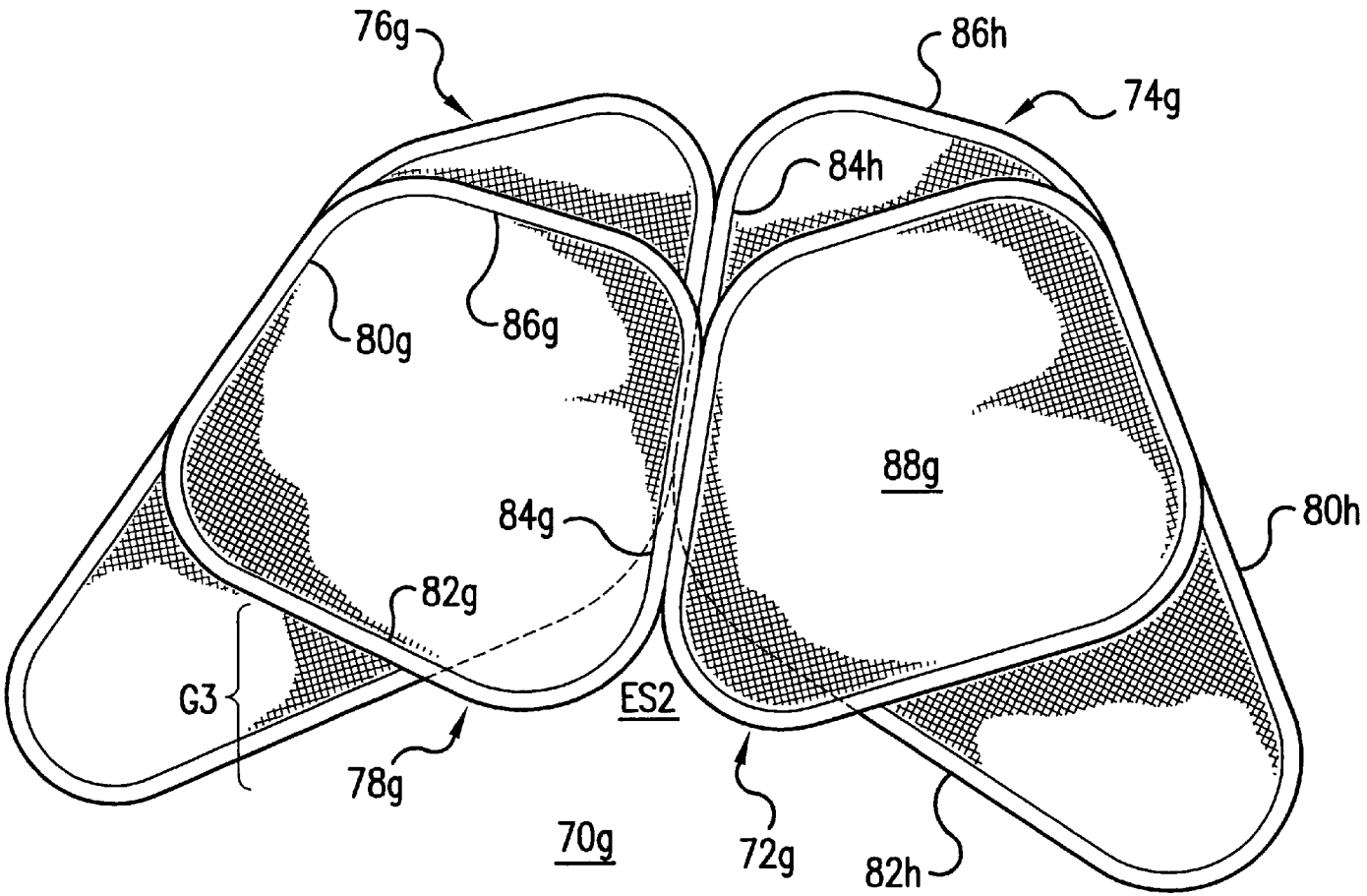
FIGS. 7–11 are perspective views of collapsible structures according to other embodiments of the present invention.

FIG. 7 illustrates another collapsible structure 70*g* according to the present invention. The structure 70*g* has four side panels 72*g*, 74*g*, 76*g* and 78*g* hingedly connected to each other to encircle an enclosed space ES2. Each panel 72*g* and 78*g* has four sides, a left side 80*g*, a bottom side 82*g*, a right side 84*g*, and a top side 86*g*. Each panel 74*g* and 76*g* has four sides, a left side 80*h*, a bottom side 82*h*, a right side 84*h*, and a top side 86*h*. The left side 80*g* or 80*h* of each panel 72*g*, 74*g*, 76*g*, 78*g* is hingedly coupled to the right side 84*g* or 84*h* of an adjacent panel 72*g*, 74*g*, 76*g*, 78*g* to encircle the enclosed space ES2. Each panel 72*g*, 74*g*, 76*g*, 78*g* is also supported by a continuous frame member such as frame member 44, and has fabric 88*g* that extends across each panel 72*g*, 74*g*, 76*g*, 78*g*, and is held taut by the respective frame members when in its open position.

In the structure 70*g*, two adjacent panels 74*g* and 76*g* have the same shape and size, and the other two adjacent panels 72*g* and 78*g* have the same shape and size, but a slightly different shape and a different size from the panels 74*g* and 76*g*. Specifically, the bottom side 82*g* of the adjacent panels 72*g* and 78*g* are raised when compared with the bottom sides 82*h* of the other two adjacent panels 74*g* and 76*g*. The bottom sides 82*h* of the panels 74*g* and 769 therefore contact the ground or surface when the structure 70*g* is fully expanded and deployed, and the bottom sides 82*g* of the panels 72*g* and 78*g* are vertically raised from the ground by a gap or space G3. This gap G3 can be used to allow ingress and egress, or can be used to allow ventilation of air into the enclosed space ES3, or can be used for other purposes. As with FIGS. 3A and 4, the left and right sides 80*g*, 80*h* and 84*g*, 84*g* of the panels 72*g*, 74*g*, 76*g* and 78*g* can either be vertical or angled.

Figure 8:
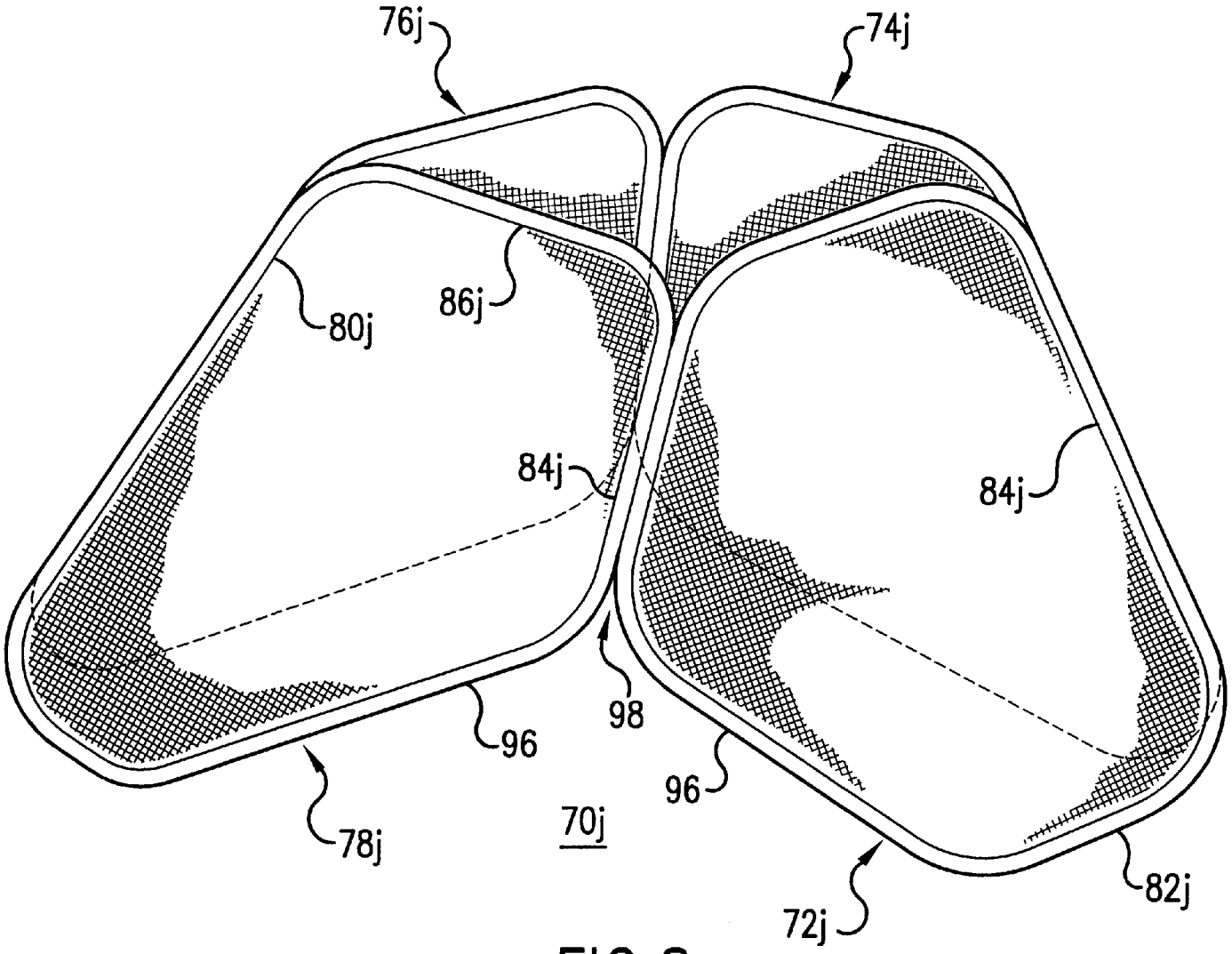

The structure 70*j* in FIG. 8 illustrates a modification of the structure 70*g* in FIG. 7. The panels 74*j* and 76*j* are the same as panels 74*g* and 769 in FIG. 7, and the panels 72*j* and 78*j* correspond to panels, 72*g* and 78*g* in FIG. 7, but here, the shape of the panels 72*j* and 78*j* has been changed. Specifically, each panel 72*j* and 78*j* has five sides, a left side 80*j*, a top side 86*j*, a right side 84*j*, a short bottom side 82*j* extending from either the left side 80*j* or the right side 84*j*, and a diagonal side 96 extending between the bottom side 82*j* and either the left side 80*j* or the right side 84*j*. In other words, the panels 72*j* and 78*j* have essentially the same size as the panels 74*j* and 76*j* except that a lower corner has been removed by providing the diagonal side 96 (i.e., the short left side 80*j* of the panel 72*j* is hingedly coupled to the short right side 84*j* of the panel 78*j*). The two diagonal sides 96 of the two adjacent panels 72*j* and 78*j* are adjacent to each other to form an opening 98 to allow ingress and egress, or can be used to allow ventilation of air into the structure 70*j*, or can be used for other purposes.

Figure 9:
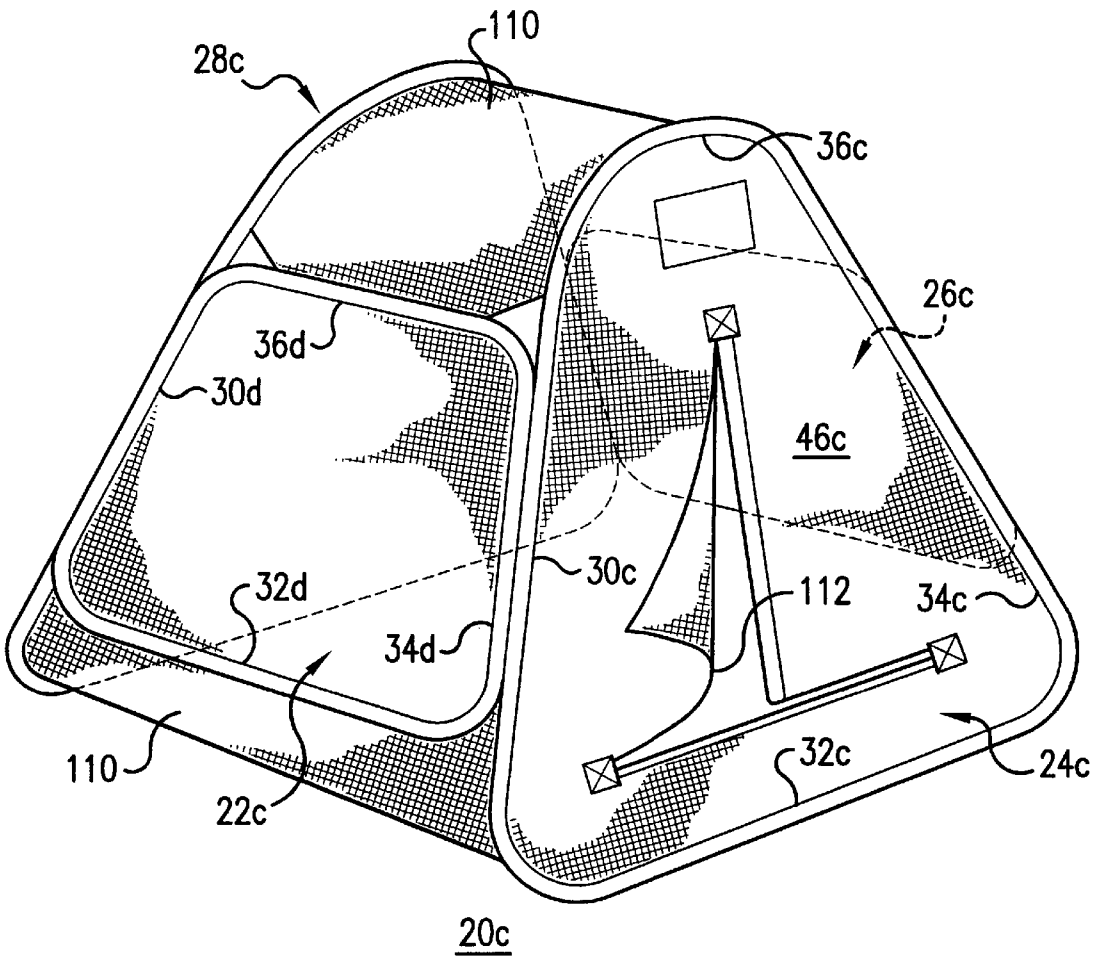

Even though the above-described embodiments provide the smaller panels adjacent the top of the respective structures, it is also possible to position the smaller panels anywhere along the sides of the larger panels. For example, FIG. 9 illustrates a structure 20*c* which is a modification of the structure 20 in FIG. 1. The panels 24*c* and 28*c* are the same as panels 24 and 28 in FIG. 1, but the panels 22*c* and 26*c* have a slightly different shape, and are positioned at a different location along the sides 30*c* and 34*c* of the panels 24*c* and 28*c*. Specifically, each smaller panel 22*c* and 26*c* has four sides 30*d*, 32*d*, 34*d* and 36*d*, with the left side 30*d* of each smaller panel 22*c* and 26*c* hingedly coupled the right side 34*c* of one of the larger panels 24*c* and 28*c*, and with the right side 34*d* of each smaller panel 22*c* and 26*c* hingedly coupled the left side 30*c* of one of the larger panels 24*c* and 28*c*. In addition, the smaller panels 22*c* and 26*c* are coupled to the mid-portion of the sides 30*c* and 34*c* of the larger panels 24*c* and 28*c*, so that the bottom side 32*d* of each smaller panel 22*c*, 26*c* is still raised from the bottom side 32*c* of the larger panels 24*c* and 28*c*. Fabric material 110 can be stitched to the sides 30*c*, 34*c* and corners 36*c* of the larger panels 24*c*, 28*c*, and the top sides 36*d* and bottom sides 32*d* of the smaller panels 22*c* and 26*c*, to form an enclosure such as a tent. For example, a slit 112 can be provided in the fabric 46*c* to form an opening for ingress and egress.

Figure 10:
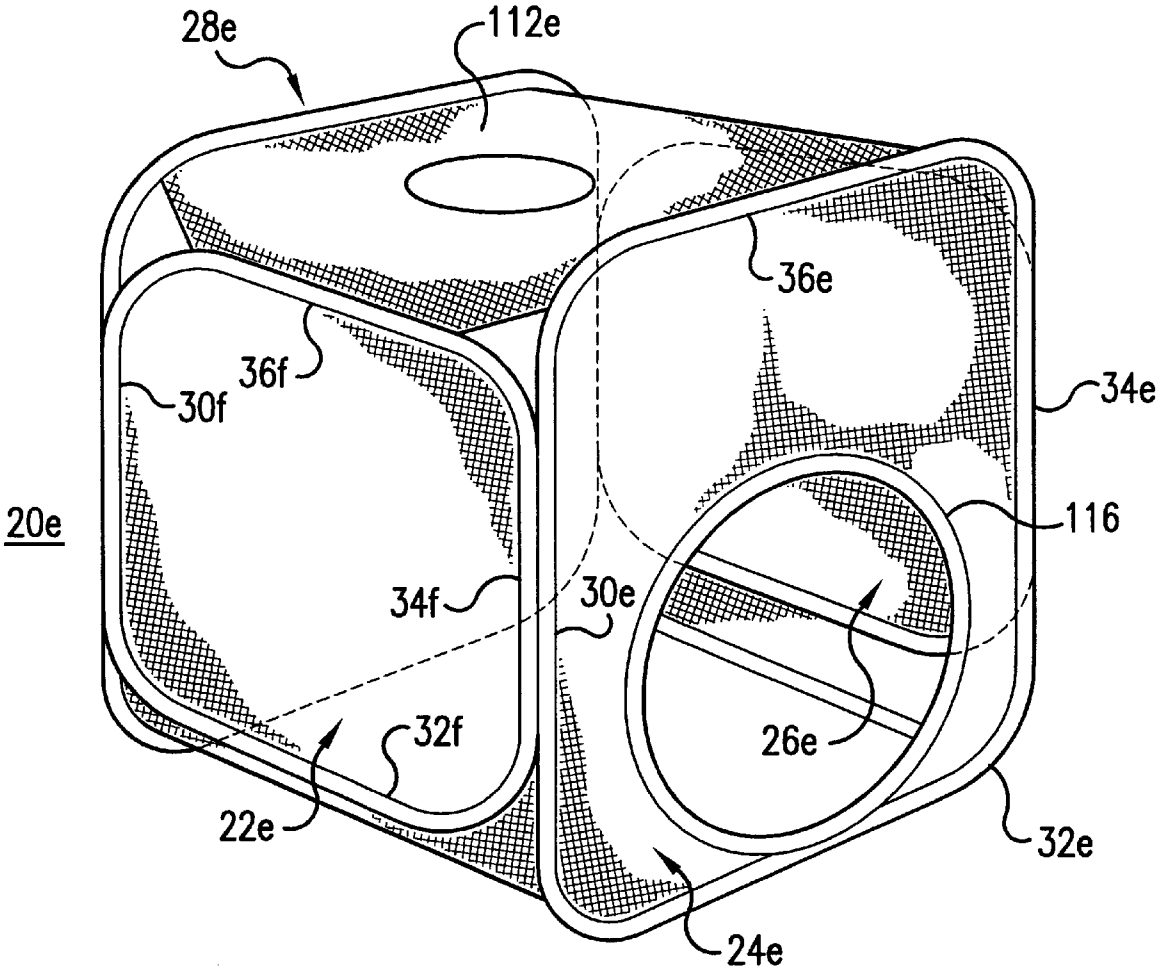

The structure 20*e* in FIG. 10 illustrates a modification to the structure 20*c* in FIG. 9. The smaller panels 22*e* and 26*e* can be the same as panels 22*c* and 26*c* in FIG. 9, but the panels 24*e* and 28*e* have four sides 30*e*, 32*e*, 34*e*, 36*e*. The smaller panels 22*e*, 26*e* are still are coupled via their sides 30*f* and 34*f* to the mid-portion of the sides 30*e* and 34*e* of the larger panels 24*e* and 28*e*, so that the bottom side 32*f* of each smaller panel 22*e*, 26*e* is still raised from the bottom side 32*e* of the larger panels 24*e* and 28*e*. Fabric material 110*e* can also be stitched to the sides 30*e*, 34*e*, 36*e* of the larger panels 24*e*, 28*e*, and the top sides 36*f* and bottom sides 32*f* of the smaller panels 22*e* and 26*e*, to form an enclosure such as a play structure. The play structure 20*e* can have an opening 116 provided in the fabric 46*e* of a panel 24*e*.

Figure 11:
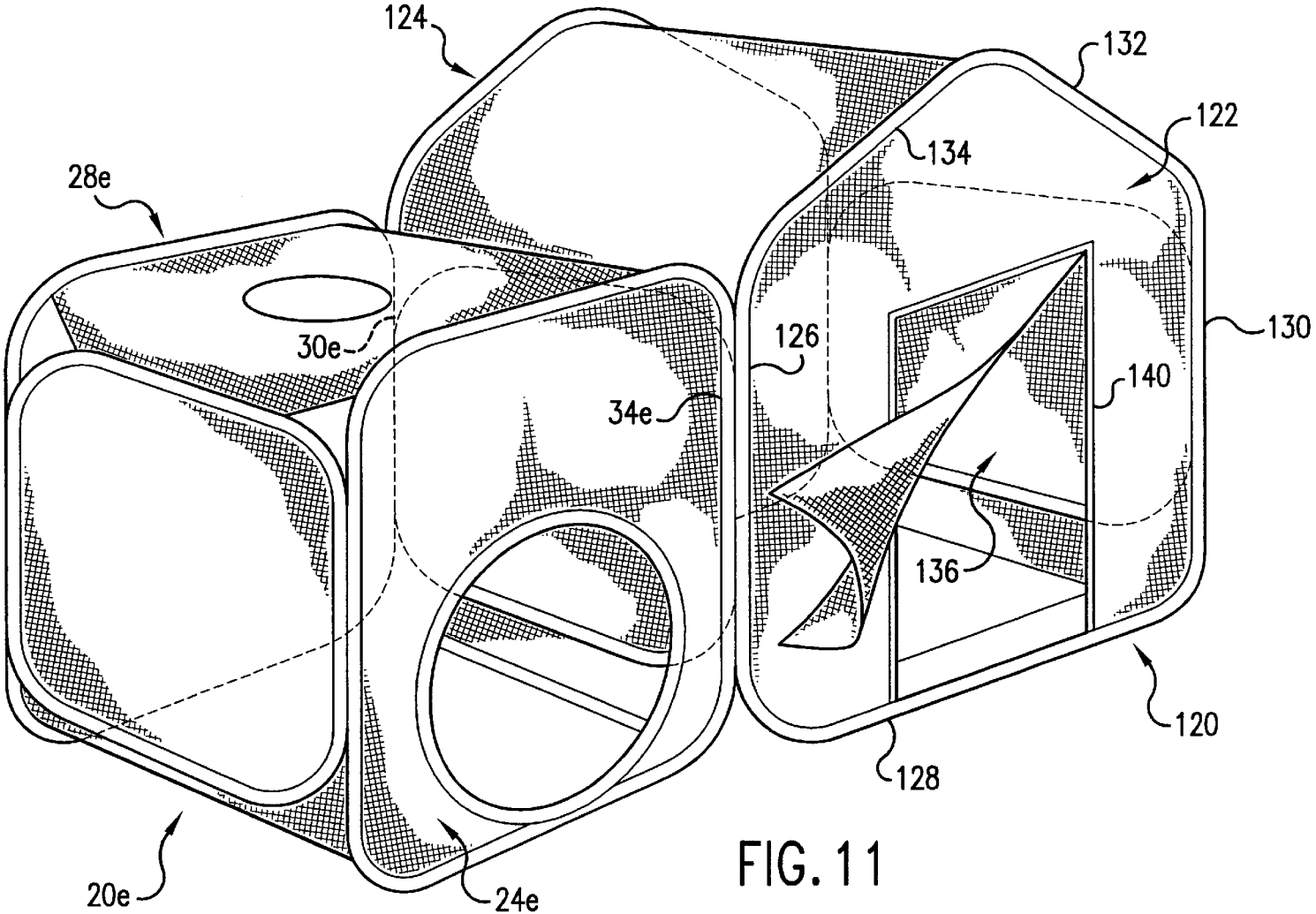

The structures illustrated in the above-described embodiments can also be linked or otherwise coupled to other similar structures. For example, FIG. 11 illustrates the structure 20*e* of FIG. 10 being coupled to another structure 120. The structure 120 can be the same as structure 20*e* except that each of the two larger panels 122, 124 can have five sides 126, 128, 130, 132, 134. An opening 140 can be provided in the fabric 142 of the panel 122 for ingress and egress. Otherwise, the two smaller panels (e.g., 136) can be the same as the smaller panels 22*e* and 26*e* of structure 20*e* in FIG. 10. Here, the right side 34*e* of the panel 24*e* of structure 20*e* can be coupled (e.g., by removable attachment mechanisms) to the left side 126 of the panel 122 of structure 120, and the left side 30*e* of the panel 28*e* of structure 20*e* can be coupled (e.g., by removable attachment mechanisms) to the right side 130 of the panel 124 of structure 120. The two structures 20*e* and 120 can be separated and then each structure 20*e* and 120 can be separately twisted and folded in accordance with the technique illustrated in FIGS. 3B–3G.

Thus, the present invention provides collapsible structures having panels that are provided in different shapes and sizes, so as to allow for different configurations to be fashioned. These different configurations provide the end-user with increased variety in play and use, and enhances the utility of these structures.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure adapted to be supported on a surface and comprising:

at least three foldable frame members, each having a folded and an unfolded orientation;

a fabric material covering portions of each frame member to form a panel for each frame member;.

each panel further including a left side, a bottom side and a right side, with the left side of each panel coupled to the right side of an adjacent panel, and the right side of each panel coupled to the left side of another adjacent panel; and wherein the bottom side of at least one panel is positioned at a higher vertical level than the bottom side of at least one other panel.

2. The structure of claim 1, wherein the bottom side of each panel has opposing first and second ends, with the first end of the bottom side connected to the left side and the second end of the bottom side connected to the right side.

3. The structure of claim 1, wherein the left side and right side of each panel is vertical.

4. The structure of claim 1, wherein the at least three frame members define four panels, with the bottom side of a first panel being positioned at a higher vertical level than the bottom sides of the other three panels.

5. The structure of claim 1, wherein the at least three frame members define four panels, with the bottom side of a first panel and a second panel being positioned at a higher vertical level than the bottom sides of a third panel and a fourth panel.

6. The structure of claim 5, wherein the first panel and the second panel are opposite from each other, and the third and fourth panels are opposite from each other.

7. The structure of claim 5, wherein the first panel and the second panel are adjacent to each other, and the third and fourth panels are adjacent to each other.

8. The structure of claim 6, wherein the third and fourth panels each has a top side, and wherein the top side of the third panel is hingedly coupled to the top side of the fourth panel.

9. The structure of claim 6, wherein the first and second panels have a triangular configuration.

10. The structure of claim 1, wherein the left side of the at least one panel is hingedly coupled to a portion of the right side of an adjacent panel.

11. The structure of claim 1, wherein the left side of the at least one panel is hingedly coupled to a portion of the right side of an adjacent panel.

12. The structure of claim 1, wherein the left side of the at least one panel is hingedly coupled to a central portion of the right side of an adjacent panel.

13. The structure of claim 11, further including a fabric covering that is connected to the portions of the right side of the adjacent panel that are not coupled to the left side of the at least one panel.

14. The structure of claim 6, wherein the first and second panels have a square configuration.

* * * * *